United States Patent [19]

Stearley

[11] 4,049,191

[45] Sept. 20, 1977

[54] BLOCK BOTTOM VALVE BAG

[75] Inventor: Robert J. Stearley, Des Moines, Iowa

[73] Assignee: Great Plains Bag Corporation, Des Moines, Iowa

[21] Appl. No.: 654,567

[22] Filed: Feb. 2, 1976

[51] Int. Cl.[2] ..... B65D 31/14

[52] U.S. Cl. ..... 229/62.5

[58] Field of Search ..... 229/62.5; 150/9

[56] References Cited

U.S. PATENT DOCUMENTS

| | | | |
|---|---|---|---|
| 2,490,966 | 12/1949 | Johnsson | 229/62.5 |
| 3,000,551 | 9/1961 | Atwood | 229/62.5 |
| 3,040,967 | 6/1962 | Klein | 229/62.5 |
| 3,261,267 | 7/1966 | Becker | 229/62.5 X |
| 3,378,190 | 4/1968 | White | 229/62.5 |
| 3,724,461 | 4/1973 | Eisenberg | 229/62.5 X |
| 3,734,154 | 5/1973 | Polk | 229/62.5 X |
| 3,894,682 | 7/1975 | Harmsen | 229/62.5 |

*Primary Examiner*—Stephen P. Garbe

*Attorney, Agent, or Firm*—Zarley, McKee, Thomte, Voorhees & Sease

[57] ABSTRACT

A block bottom valve bag comprises an elongated bag tube having opposite ends. One end of the bag is folded to form a block bottom closure comprising first and second side flaps folded toward one another in overlapping relationship and adhered to one another, and a pair of end flaps extending inwardly beneath the side flaps at the opposite ends thereof. An elongated valve member extends between one of the end flaps and overlapped side flaps. The valve member comprises an elongated flexible valve tube collapsed into a flat configuration having upper and lower walls in facing relation. The upper wall is operatively secured to the interior surfaces of the side flaps and the lower wall of the valve tube is operatively secured adjacent one end thereof to the end flap and is detachably secured adjacent the other end thereof to the end flap. A reinforcing sheet member may be interposed between and adhered to the under surface of the side flaps and the upper surface of the valve tube.

8 Claims, 10 Drawing Figures

BLOCK BOTTOM VALVE BAG

SUMMARY OF THE INVENTION

This invention relates to a block bottom valve bag which may be either a multi-ply bag or a single ply bag.

Block bottom valve bags conventionally include tubular valves mounted in one end thereof. The tubular valves provide communication into the interior of the bag so that the bag may be filled by inserting a filling spout into the tube and filling the bag by introducing the contents into the bag through the filling spout. After the bag is filled, the contents of the bag compress the valve tube into a flattened condition so as to seal the contents of the bag.

Several problems are presently encountered with the valve tubes utilized in present block bottom valve bags. These tubes are often difficult to open, and therefore, considerable time is lost in opening the tube so that the filling spout may be inserted. Also, the valve tubes of presently known bags often provide an inadequate seal after filling, and sifting often takes place. Similarly, insects often penetrate through the valve into the contents of the bag. Present-day valves provide no means for folding or tucking them under after the bag has been filled.

The present invention utilizes a unique valve tube which can be opened merely by grasping the end closure of the bag and squeezing the end closure. A releasable glue spot permits the valve to be opened in this manner. After the bag is filled, the glue spot may be broken manually so that the valve tube may be folded easily to provide a better seal. A polyethylene valve tube, more flexible than presently used paper tubes, provides better sealing.

Therefore, a primary object of the present invention is the provision of a block bottom valve bag which can be opened easily for filling.

A further object of the present invention is the provision of a block bottom valve bag which includes a valve tube capable of being tucked and folded after the bag has been filled.

A further object of the present invention is the provision of a block bottom valve bag having polyethylene valve tube which provides a superior seal after the bag has been filled.

A further object of the present invention is the provision of a block bottom valve bag which utilizes a spot adhesive for facilitating opening of the bag, the bond of said adhesive being easily breakable after filling to permit the valve tube to be tucked in for superior sealing.

A further object of the present invention is the provision of a block bottom valve bag which is economical and simple to manufacture, and reliable in use.

BRIEF DESCRIPTION OF THE VIEWS OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION

Figure 1:
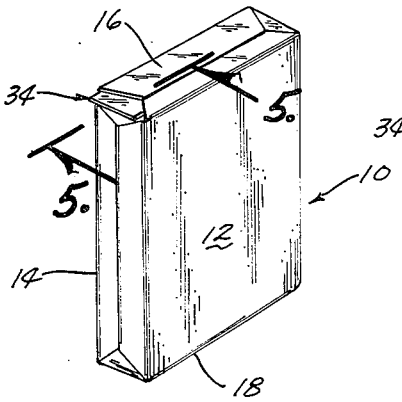
FIG. 1 is a pictorial view of the block bottom valve bag of the present invention.

Referring to the drawings, the numeral 10 generally designates the block bottom valve bag of the present invention. Bag 10 includes a front wall 12, a rear wall 14, and end walls 16, 18. Bag 10 is formed from an elongated tube which may be of single ply or multi-ply construction.

Figure 5:
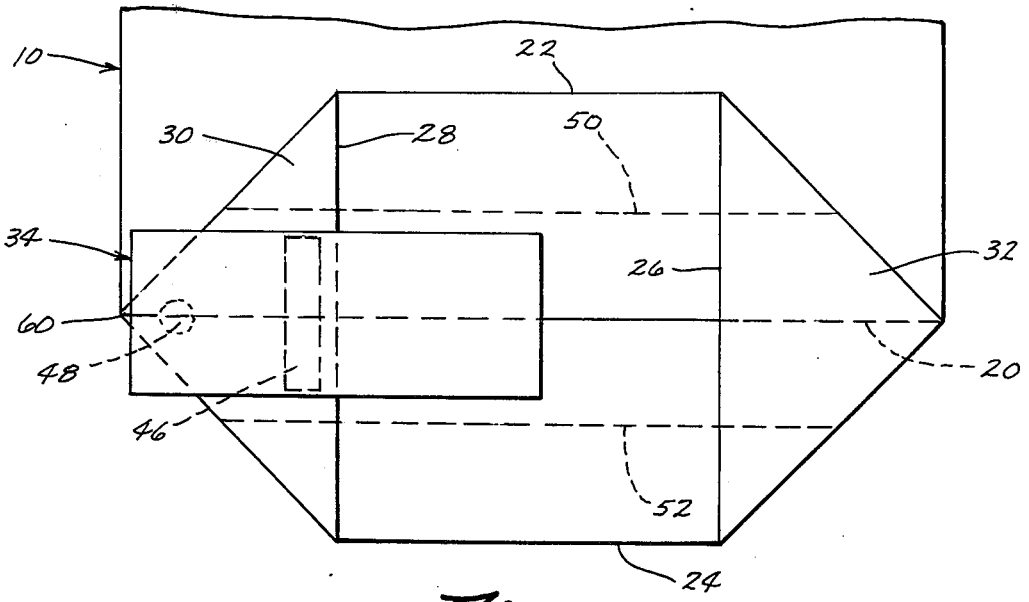
FIG. 5 is a plan view of the end closure of the block bottom valve bag in a partially folded position.
Figure 6:
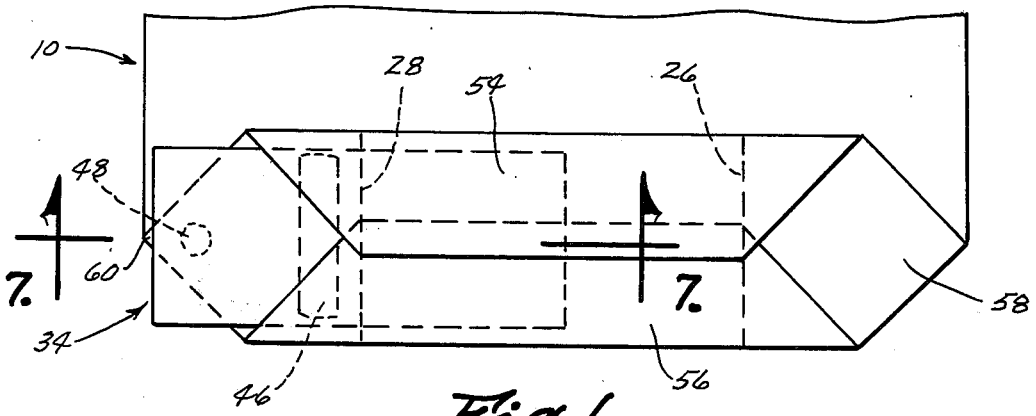
FIG. 6 is a plan view similar to FIG. 5 illustrating a further step in the folding of the end closure.

FIGS. 5 and 6 illustrate the manner in which the end closures 16 and 18 are formed. In FIG. 5 the end of bag 10 is shown in a partially folded position. The end of the tube which forms bag 10 has been folded transversely along line 20 and then spread apart so that the open end of the tube forms a rectangle having side edges 22, 24 and end edges 26, 28. End edges 26, 28 form the base for two triangular gusset flaps 30, 32.

Figure 2:
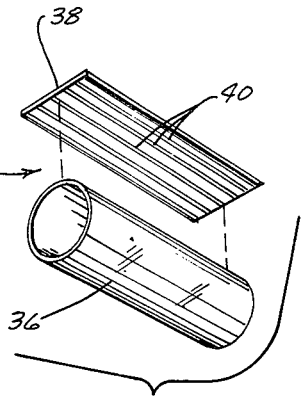
FIG. 2 is an exploded perspective view of the valve tube utilized in the present invention.
Figure 3:
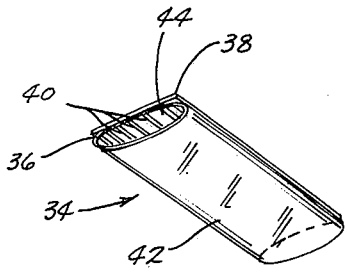
FIG. 3 is a pictorial view of the valve tube of FIG. 2 in its collapsed position.

A valve member 34 is positioned over qusset flap 30. Valve member 34 is illustrated in FIGS. 2 and 3 and includes a polyethylene cylindrical tube 36 which is adhered to a paper reinforcing member 38 by means of a plurality of glue lines 40. FIG. 3 illustrates valve member 34 in a collapsed position wherein tube 36 includes a bottom wall 42 and a top wall 44, top wall 44 being adhered to the under surface of reinforcing member 38.

As viewed in FIG. 5, valve member 34 is positioned over gusset flap 30, with bottom wall 42 being in facing engagement with gusset flap 30. A first glue line 46 is positioned parallel to an adjacent end edge 28, and forms a bond between bottom wall 42 and gusset flap 30. A glue spot 48 is positioned adjacent the apex of gusset flap 30 and forms a detachable bond between bottom wall 42 and gusset flap 30.

Various types of glues are presently avaiable on the market for providing glue spot 48. The primary requisite of glue spot 48 is that it will yield in response to manual pulling of bottom wall 42 away from gusset flap 30 so that valve member 34 may be detached from gusset flap 30 adjacent glue spot 48.

After valve 34 has been secured in a position shown in FIG. 5, the end closure is folded again along lines 50, 52 so as to provide two side flaps 54, 56 which are folded over one another in overlapping relationship. Flaps 54, 56 are glued to one another in their overlapped portions and are also glued to the central portion of gusset flap 32. The central portion of gusset flap 32 may be referred to for purposes of reference as end flap 58. When triangular gusset 32 is folded over, it forms a tubular sleeve which extends inwardly beneath the end of side flap 54, 56 and which terminates at end edge 26. This sleeve would normally provide communication into the interior of the bag, but is prevented from doing so by virtue of the fact that end flaps 54, 56 are glued to gusset flap 58.

Figure 7:
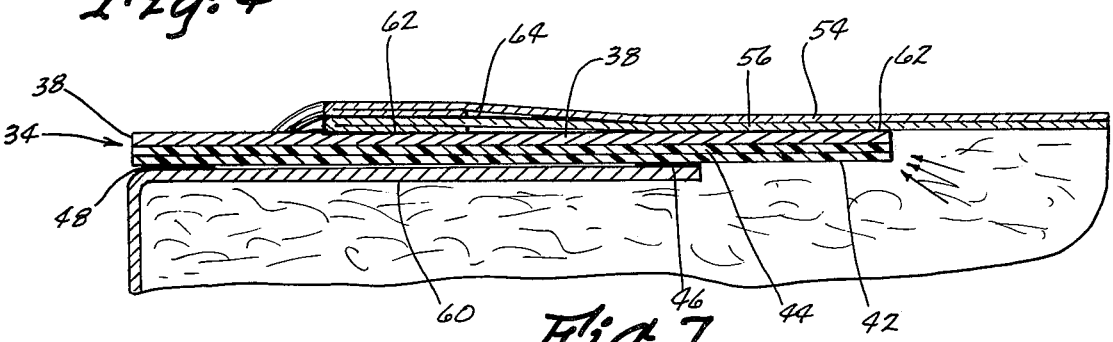
FIG. 7 is a sectional view taken along line 7—7 of FIG. 6.
Figure 9:
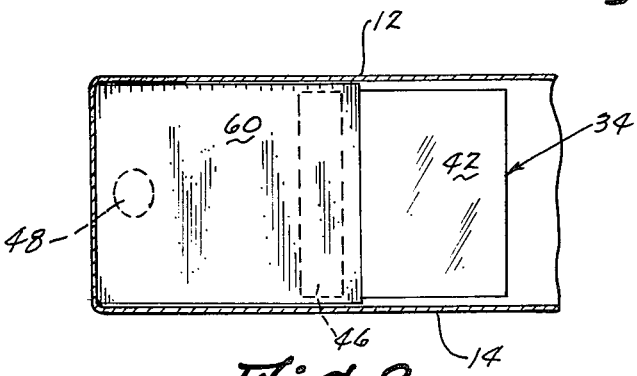
FIG. 9 is a sectional view taken along lines 9—9 of FIG. 8.

Valve 34 is interposed between end flap 60 which is similar to end flap 58 and the overlapped side flaps 54, 56. Side flaps 54, 56 are adhered to the upper surface of reinforcing member 38 so that valve 34 is sealed within the sleeve formed by triangular gusset flap 30. The glue bond between reinforcing member 38 and flaps 54, 56 is designated by the numeral 62 in FIGS. 7 and 8. The glue bond between side flaps 54, 56 is designated by the numeral 64.

Figure 10:
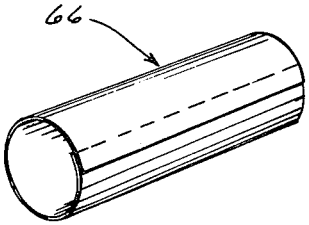
FIG. 10 is a pictorial view of the modified form of the valve tube of the present invention.

Referring to FIG. 10, a modified valve 66 is shown which is formed from a cylindrical sleeve. Valve 66 may be any flexible material, but it is preferred tht the material be polyethylene. Valve 66 is glued in place in the same manner in which valve 34 is glued in place, with the exception that a reinforcing member 38 is not utilized.

Figure 4:
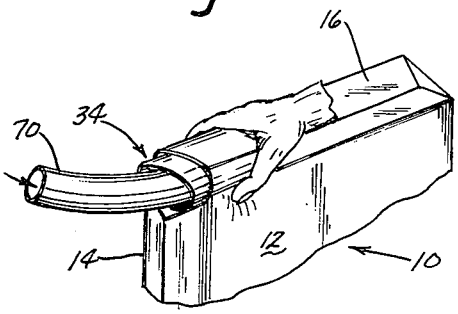
FIG. 4 is a perspective view of the upper end of a block bottom valve bag utilizing the valve tube of the present invention for filling the bag.
Figure 8:
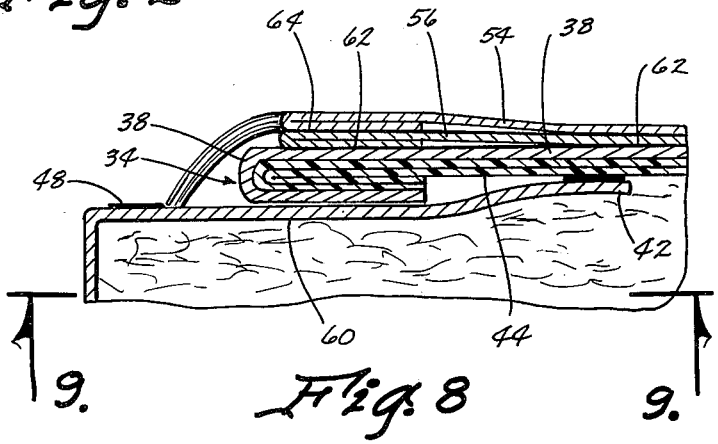
FIG. 8 is a view similar to FIG. 7 illustrating the valve tube in a tucked-under position.

The bag is illustrated in its proper filling position in FIG. 4. A filling spout 70 is shown inserted within valve tube 34. In order to prepare valve tube 34 for receiving spout 70, the operator need merely grasp the sides of valve tube 34 as illustrated in FIG. 4. The operator then presses the opposite sides of the valve tube toward one another, and the valve tube opens by virtue of the fact that its upper wall 44 and reinforcing member 38 are adhered to the overlapped side flaps 54, 56, and also by virtue of the fact that glue spot 48 holds bottom wall 42 of valve member 34 against upward movement in unison with upper wall 44. The resulting action is that upon compression of the sides of valve tube 34, the valve tube opens to receive spout 70. After the bag has been filled through spout 70, the operator removes spout 70. Then the operator lifts the outer end of the valve tube 34 upwardly so as to separate bottom wall 42 from glue spot 48. The end of valve tube 34 is then tucked under, as illustrated in FIG. 8, thereby forming a seal to prevent the contents of the bag from exiting through valve tube 34. Another important feature of valve tube 34 is the fact that it protrudes inwardly beyond the end of end flap 60, thereby exposing the polyethylene tube wall 42, 44 to the contents of the bag. These flexible polyethylene tube walls compress in response to pressure from the contents of the bag and further provide an improved seal against leakage.

Another advantage obtained by the valve tube of the present invention is derived from the fact that it protrudes further into the bag than previous devices. As a result of this construction, there is less product blown outwardly from the tube during the filling operation. Normally, the products are filled through spout 70 at a very high velocity, and often dust and product are blown outwardly through the valve during the filling operation. Because the present valve extends further into the bag, it minimizes this blowing out of the product during the filling operation.

Thus, it can be seen that the device accomplishes at least all of its stated objectives.

What is claimed is:

1. A block bottom bag comprising:

a front wall, a back wall, and opposite end walls forming an enclosed container, said end walls having an interior facing surface and an exterior facing surface;

at least one of said end walls having an approximately flat configuration and having a valve opening formed therein;

a valve member extending through said valve opening, said valve member comprising an elongated flexible tube collapsed into a flat configuration having an upper tube wall and a lower tube wall in facing engagement;

said valve member having a first end extending within the interior of said container and a second end extending outwardly from the exterior of said container;

said upper wall of said flexible tube being operatively secured to the interior surface of said end wall whereby upward flexing movement of said end wall causes upward flexing movement of said upper wall of said flexible tube;

said lower wall of said flexible tube being detachably secured to the exterior facing surface of said end wall adjacent said second end of said tube so as to prevent said lower wall from moving upwardly when said upper wall is flexed upwardly.

2. A block bottom bag comprising: an elongated bag tube having opposite ends;

at least one end of said bag tube being folded to form a block closure, said closure comprising first and second side flaps folded towards one another in overlapping relationship and adhered to one another, and a pair of end flaps extending inwardly beneath said side flaps at the opposite ends thereof;

an elongated valve member extending between one of said end flaps and said overlapped side flaps, one end of said valve member being inside said bag tube and the other end of said valve member being outside said bag tube;

said valve member comprising an elongated flexible valve tube member collapsed into a flat configuration having an upper wall and a lower wall in facing relation, said upper wall being operatively secured to the interior surfaces of said side flaps and said lower wall of said valve tube member being operatively secured adjacent said one end thereof to said end flap, and being detachably secured adjacent said other end to said end flap.

3. A block bottom bag comprising:

a front wall, a back wall, and opposite end walls forming an enclosed container, said end walls having an interior facing surface and an exterior facing surface;

at least one of said end walls having approximately flat configuration and having a valve opening formed therein;

a valve member extending through said valve opening, said valve member comprising an elongated flexible tube collapsed into a flat configuration having an upper tube wall and a lower tube wall in facing engagement;

said valve member having a first end extending within the interior of said container and a second end extending outwardly from said exterior of said container;

said upper wall of said flexible tube being operatively secured to the interior surface of said end wall whereby upward flexing movement of said end wall causes upward flexing movement of said upper wall of said flexible tube;

said lower wall of said flexible tube being detachably secured to the exterior facing surface of said end wall adjacent said second end of said tube so as to prevent said lower wall from moving upwardly when said upper wall is flexed upwardly, and a reinforcing sheet member interposed in said valve opening of said end wall between said end wall and the upper wall of said tube member and adhered to the upper wall of said tube member.

4. A bag according to claim 3 wherein said reinforcing member has a stiffness greater than that of said flexible tube and is sufficiently flexible to be flexed manually into a warped configuration, whereupon said tube is opened from a flat collapsed configuration to an open configuration for providing communication therethrough from the exterior to the interior of said container.

5. A block bottom bag comprising:

an elongated bag tube having opposite ends;

at least one end of said bag tube being folded to form a block closure, said closure comprising first and second side flaps folded towards one another in overlapping relationship and adhered to one another, and a pair of end flaps extending inwardly beneath said side flaps at the opposite ends thereof;

an elongated valve member extending between one of said end flaps and said overlapped side flaps, one end of said valve member being inside said bag tube and the other end of said valve member being outside said bag tube;

said valve member comprising an elongated flexible valve tube member collapsed into a flat configuration having an upper wall and a lower wall in facing relation, said upper wall being operatively secured to the interior surfaces of said side flaps and said lower wall of said valve tube member being operatively secured adjacent said one end thereof to said end flap, and being detachably secured adjacent said other end to said end flap, and a reinforcing sheet member interposed between and adhered to said upper wall of said tube member and the interior surfaces of said side flaps.

6. A bag according to claim 5 wherein said reinforcing member has a stiffness greater than that of said flexible tube and is sufficiently flexible to be flexed manually into a warped configuration, whereupon said tube is opened from a flat collapsed configuration to an open configuration for providing communication therethrough from the exterior to the interior of said container.

7. A bag according to claim 5 wherein said flexible tube is comprised of polyethylene sheet material.

8. A bag according to claim 3 wherein said flexible tube is comprised of polyethylene sheet material.

* * * * *